US005114321A

United States Patent [19]

Milburn et al.

[11] Patent Number: 5,114,321

[45] Date of Patent: May 19, 1992

[54] FLUID DISPLACEMENT APPARATUS WITH TRAVELING CHAMBERS

[75] Inventors: Ski Milburn, Boulder; Jeffrey Barber, Lafayette, both of Colo.

[73] Assignee: Vairex Corporation, Boulder, Colo.

[21] Appl. No.: 654,210

[22] Filed: Feb. 12, 1991

[51] Int. Cl.[5] ..... F04B 1/10

[52] U.S. Cl. ..... 417/467; 417/534

[58] Field of Search ..... 417/534, 466, 467, 460; 92/66, 117 R; 91/491

[56] References Cited

U.S. PATENT DOCUMENTS

| | | | |
|---|---|---|---|
| 2,130,037 | 9/1938 | Skarlund | 417/466 X |
| 4,466,335 | 8/1984 | Milburn, Jr. | 417/534 X |
| 4,612,882 | 9/1986 | Bonfilio | 91/491 X |
| 4,907,950 | 3/1990 | Pierrat | 417/273 X |
| 5,004,404 | 4/1991 | Pierrat | 417/53 |

*Primary Examiner*—Leonard E. Smith
*Attorney, Agent, or Firm*—E. T. Barrett

[57] ABSTRACT

A positive displacement apparatus of the general type used as superchargers on internal combustion engines has two or more compression chambers capable of lateral movement to accommodate circular motion of the pistons. The driving forces for the chambers are derived from forces originating independently of the movement of the pistons, that is, the chambers, instead of being driven by the pistons, are driven directly from the eccentric mechanism that drives the pistons. A lateral reciprocating motion is imparted to two transfer members that are mechanically secured to the end of, or form part of, the chamber. Preferably, each of the end plates of the chamber forms an integral part of the chamber drive structure. An orbitally-driven, non-rotating, rigid drive sleeve encompasses two spaced eccentric drive members on a drive shaft and supports the piston drive structures. Rotational forces generated by the chamber drive arrangement are resisted by sets of guides rails and slidably mounted pads.

17 Claims, 11 Drawing Sheets

FLUID DISPLACEMENT APPARATUS WITH TRAVELING CHAMBERS

BACKGROUND OF THE INVENTION

1. Field of the Invention

This invention relates to positive displacement apparatus of the general type used as superchargers on internal combustion engines and in other applications. More particularly it relates to such apparatus in which two or more compression chambers are capable of lateral movement to accommodate circular motion of the pistons and in which the driving forces for the chambers are derived from forces originating independently from the forces generated by movement of the pistons.

2. Description of Related Art

Various attempts have been made to provide compressors in which the chamber and piston assemblies are arranged to permit lateral movement during the cyclic operation of the pistons. Skarlund U.S. Pat. No. 2,130,037 describes a compressor having an outer housing with flat parallel inner sides which contains a box-shaped outer piston that itself forms a housing for a second box-shaped inner piston reciprocating at an angle of ninety degrees to the direction of movement of the first piston. U.S. patent application Ser. No. 07/305,810 filed Feb. 3, 1989 (now U.S. Pat. No. 5,004,404), which application is assigned to the same assignee as the present application, describes a compressor in which oppositely disposed pistons follow a circular path while the respective chambers housing the pistons follow lateral reciprocating paths.

In these and other similar devices, the chambers are driven laterally by the forces applied to the chamber walls by the piston rings carried by the pistons. The force of the lateral component of movement of the piston applies the driving force to the chamber. Unless the forces generated by opposing pistons are precisely balanced, a twisting or rotational torque is produced on the chamber assembly increasing friction and wear. In actual practice, relatively large uncompensated rotational torques are produced because of mechanical tolerances and other factors. This rotational torque is resisted by a linear rotary bearing or other arrangement that is positioned adjacent the eccentric drive for the pistons.

William Milburn, Jr. U.S. Pat. No. 4,466,335 describes a co-piston type device where the functions of sealing and chamber drive ar separated and replaced by sealing strips and rolling element drive systems. The described arrangement fails to address the problem of rotational torque. Perhaps, more importantly, the inner piston remains as the principle means of transmitting transitional force to the outer piston/chamber assembly.

SUMMARY OF THE INVENTION

The previous arrangements for stabilizing the movement of the chambers were satisfactory for resisting the forces caused by the pressure of gases in the chambers. However, in practice, acceleration forces on the chambers far exceed the gas pressure on the linear rotary bearings. These acceleration forces cause serious problems in the operation of the compressor including excessive friction losses at higher speeds, and problems related to stability, reliability and durability.

In the present construction, the chambers, instead of being driven by the pistons, are driven directly from the same eccentric mechanism that drives the pistons. In a preferred embodiment, an orbital chamber drive unit, driven by the same eccentric mechanism that drives the piston, generates a lateral reciprocating motion that is imparted to two transfer members that are mechanically secured to the end of, or form part of, the chamber. Preferably, each of the end plates of the chamber forms an integral part of the chamber drive mechanism. Rotational forces generated by the chamber drive arrangement are resisted by a simple guide rail and slidably mounted pad while allowing lateral movement of the chambers.

In a preferred embodiment, two spaced eccentric drive members on a common drive shaft are surrounded by a rigid drive sleeve that adds materially to the stability of the device irrespective of the method used to resist rotational torques.

The improved displacement device provides higher mechanical efficiency and permits higher operating speeds. The wear requirements on the piston rings are reduced significantly because the rings provide no driving force for the chambers.

DESCRIPTION OF THE PREFERRED EMBODIMENTS

Figure 1:
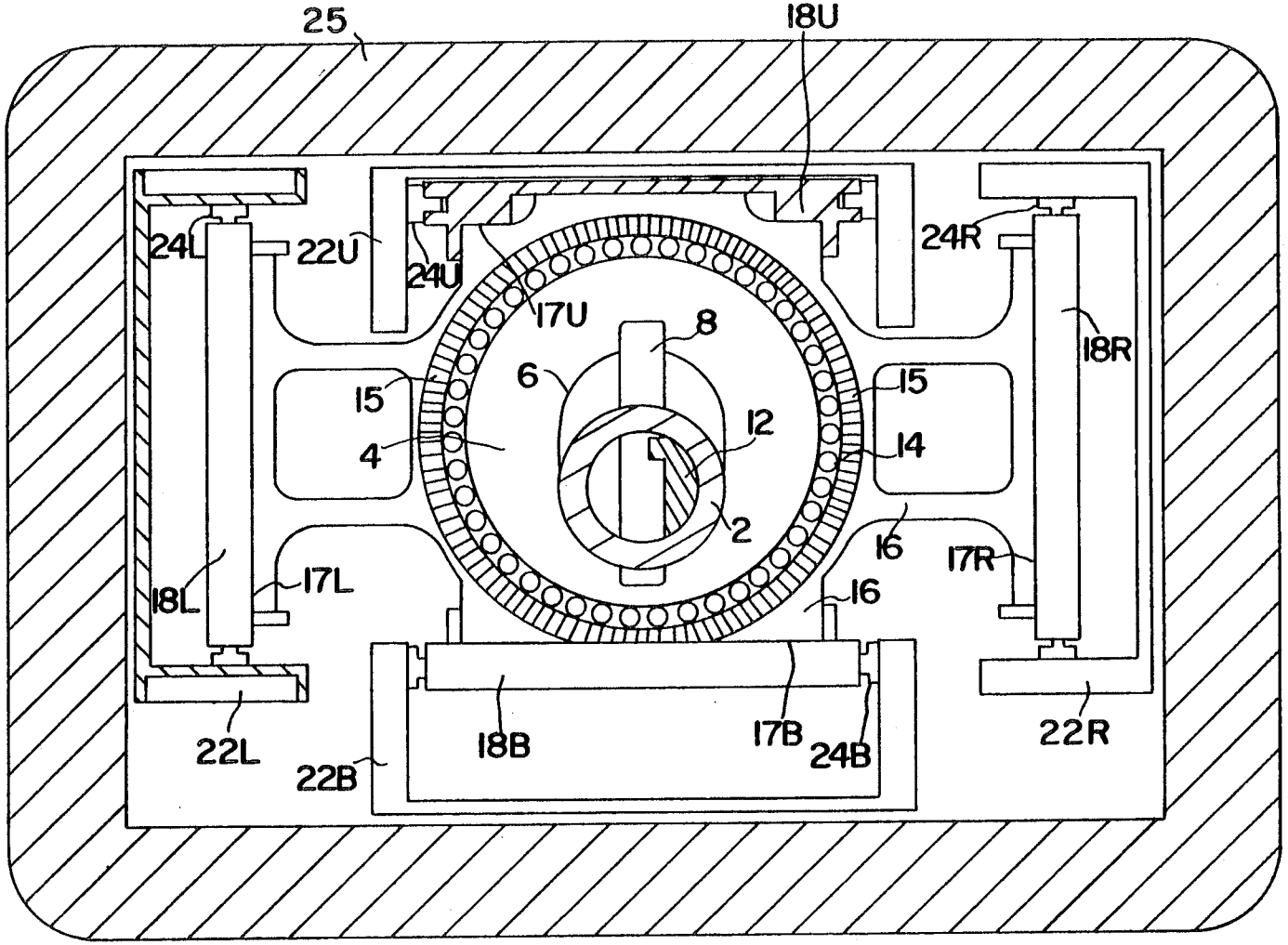
FIG. 1 is a diagrammatic sectional view of a displacement device incorporating the present invention illustrating the genera arrangement of the pistons and chambers in a four-piston displacement device.

In the various views, similar parts, or parts performing similar functions, are referred to by the same numbers followed by an identifying letter suffix. The general disposition of the chambers and pistons and the operation of the basic system are diagrammatically illustrated by FIG. 1. In a typical supercharger or compressor application, a drive shaft 2 is connected by a pulley wheel and belt to an internal combustion engine or other power source (not shown). The shaft 2 drives an eccentric drive member 4 which has an oblong opening 6 that surrounds the drive shaft 2. The eccentric drive member 4 is secured to the drive shaft by a pin 8 that is notched to receive an acuator ramp 12 that controls the position of the drive shaft 2 within the oblong opening 6 and thereby determines the stroke of the pistons. By varying the adjustment of the actuator ramp 12, the eccentricity of the drive member 4 can be controlled. This variable displacement feature does not form part of the present invention and is described more fully in the above referenced patent application and also in U.S. Pat. No. 4,907,950.

The eccentric drive member 4 is mounted in a bearing 14 that is rotatably positioned within a rigid drive sleeve 15 of an orbital-motion piston drive structure, generally indicated at 16. The piston drive structure 16 is rigidly connected by four piston support brackets 17U, 17B, 17L and 17R respectively to four radially positioned pistons 18U, 18B, 18L and 18R. Each of the pistons follows a circular orbit whose diameter is a function of the adjustment of the actuator ramp 12.

The pistons 18U, 18B, 18L and 18R are positioned respectively in one of the sliding chambers 22U, 22B, 22L and 22R. The pistons and the chambers are rectangular in cross section. Each piston carries conventional piston seals, respectively, 24U, 24B, 24L and 24R.

The circular orbit of each piston lies in a plane perpendicular to the longitudinal axis of the drive shaft 2. Each of the chambers is mounted for sliding reciprocating movement laterally with respect to the axis of the drive shaft. The apparatus is enclosed in a suitable housing, generally indicated at 25.

The lateral movement of the chambers that accompanies the orbital motion of the pistons also operates appropriate intake and exhaust valves (not shown). The structure and function of these valves is described in the above-referenced co-pending application and in U.S. Pat. No. 4,907,950.

In some previous structures, the chambers are driven by the force of the piston seals 24 against the inner surfaces of the chambers. In the present structure, the chambers are driven laterally by a positive drive means independent of the seals 24.

Figure 2:
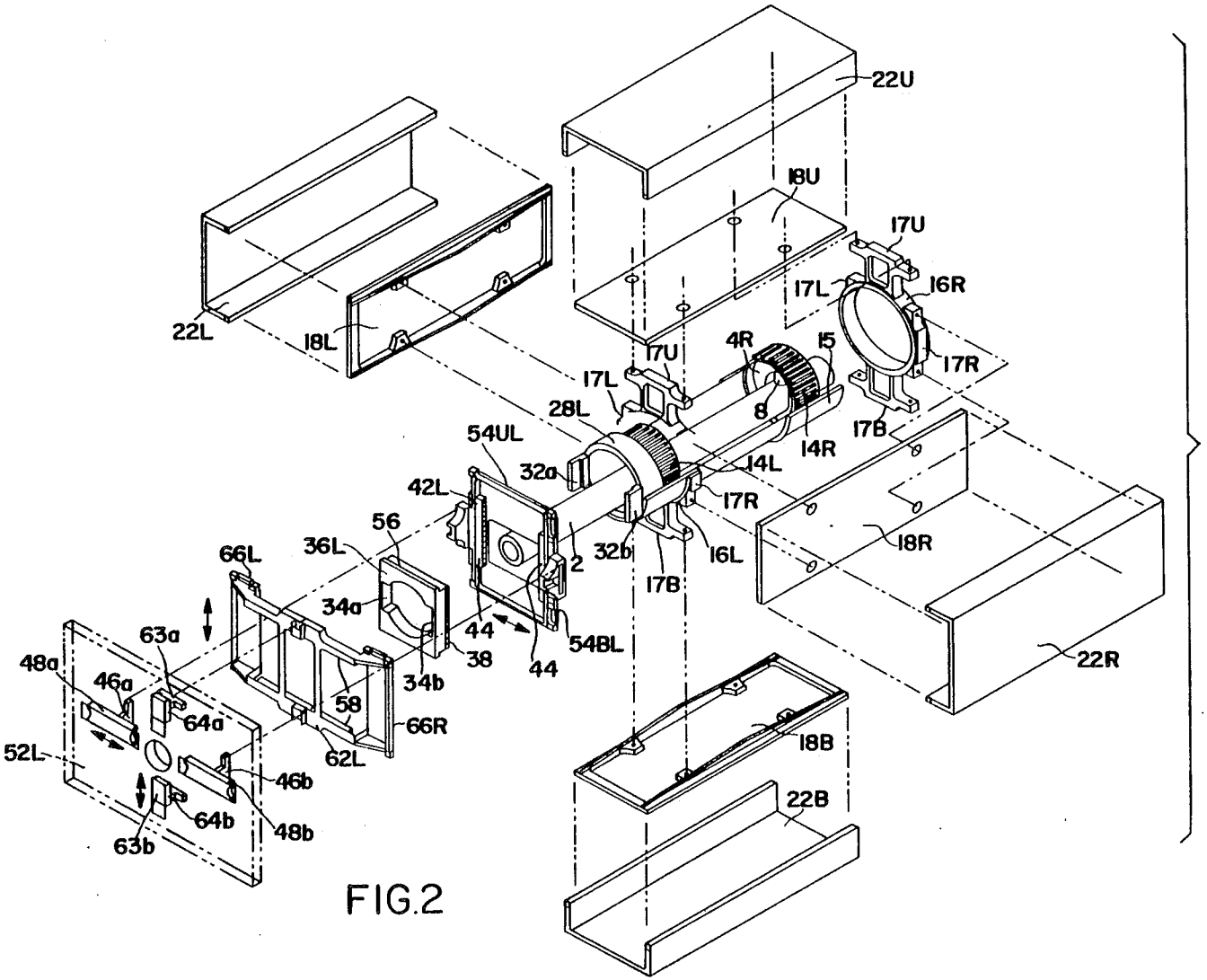
FIG. 2 is an exploded diagrammatic view showing the arrangement of the primary components in the displacement apparatus of FIG. 1.
Figure 3:
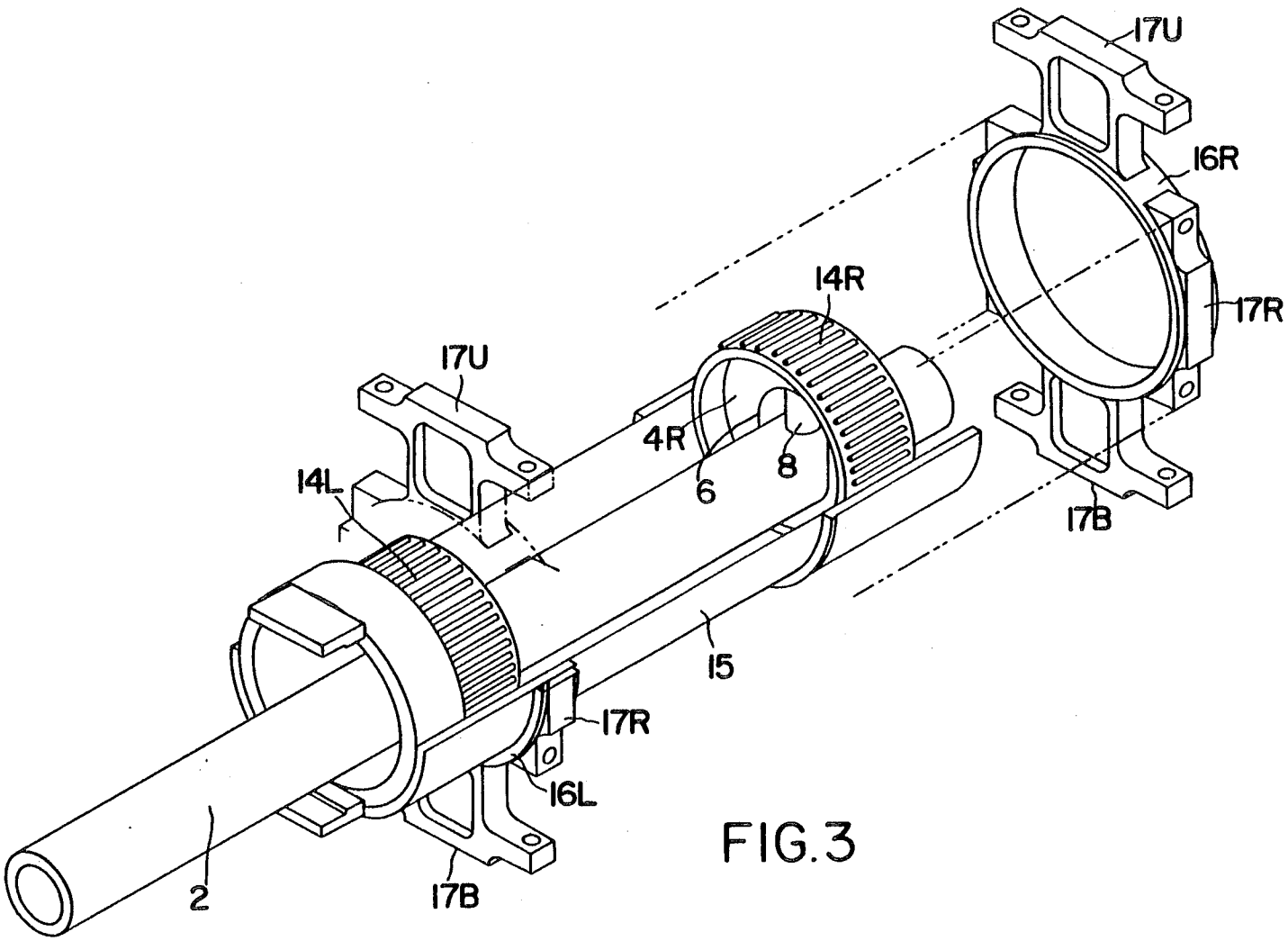
FIG. 3 is a partial perspective view showing the piston drive structure.
Figure 4:
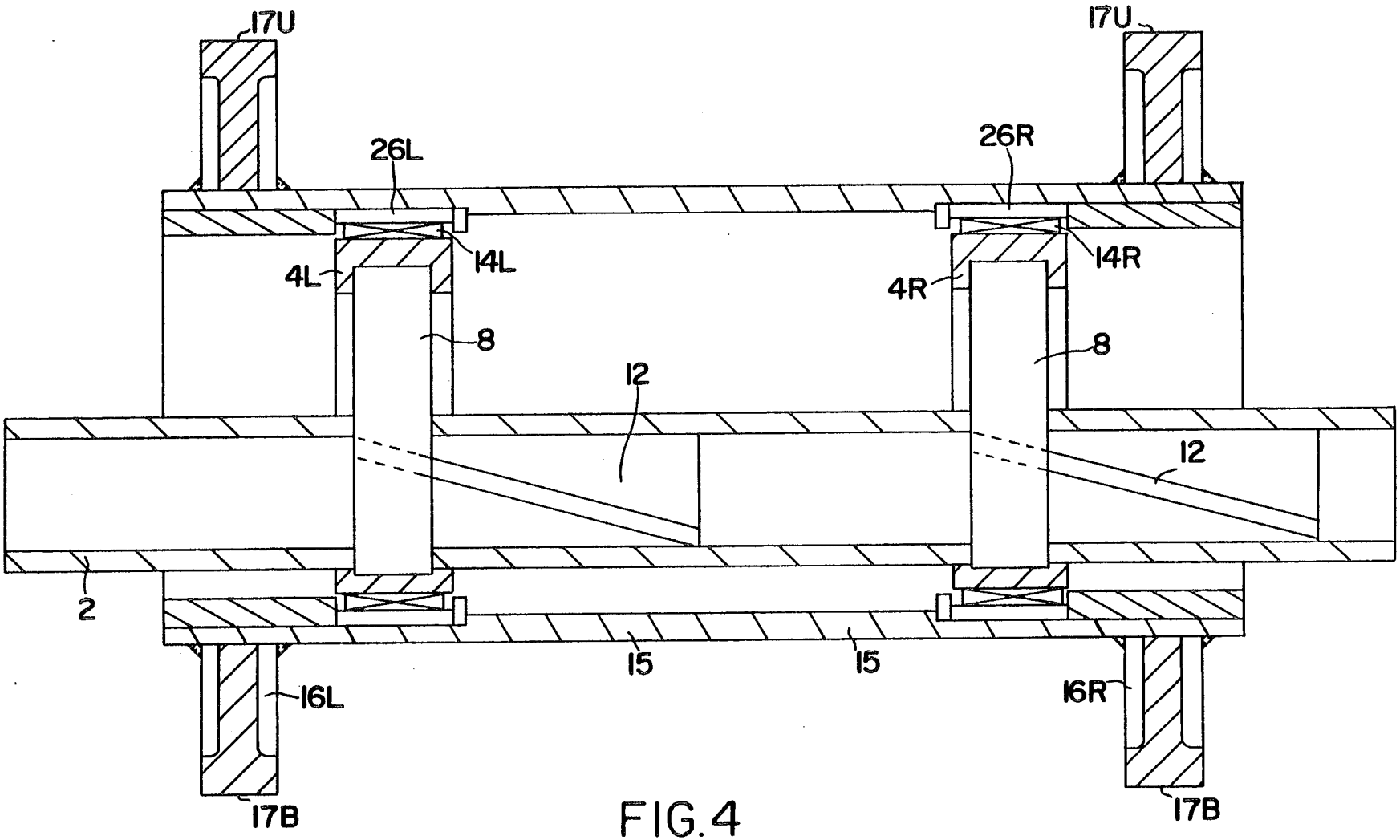
FIG. 4 is a vertical section through the drive sleeve of FIG. 3.
Figure 5:
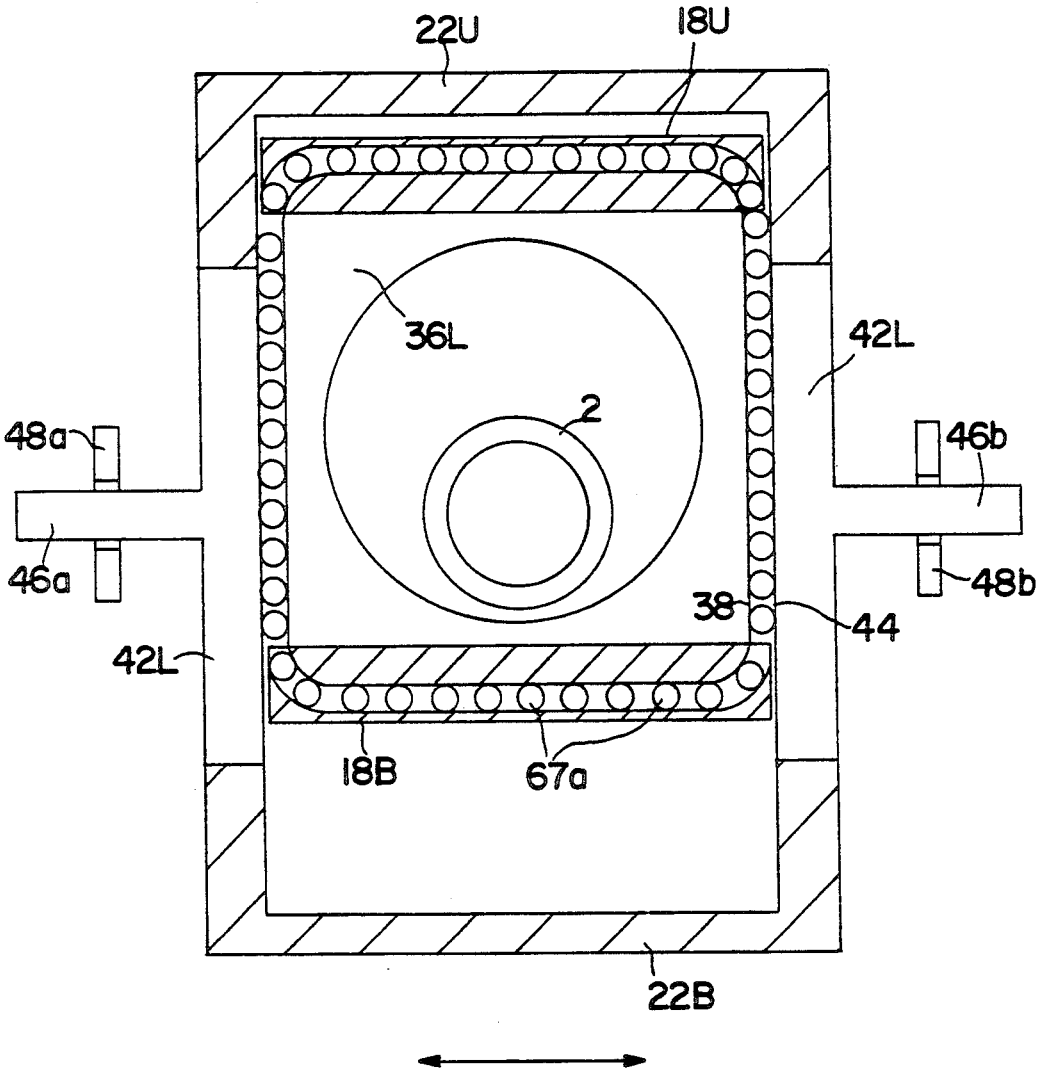
FIG. 5 illustrates an orbital chamber drive mechanism in which ball bearings, by which the orbital motions are converted into reciprocating motions, are arranged in an endless track that permits free recirculation of the ball bearings.

The positive drive mechanisms for the chambers are illustrated diagrammatically by the exploded view of FIG. 2. Rotation of the drive shaft 2 causes rotation of, two spaced eccentric drive members 4L and 4R (only member 4R is shown in this view) inside the circular bearings 14L and 14R. The outer races of the bearings 14L and 14R are formed respectively by the drive sleeve 15, partially cut away in this view, that encompasses both of the bearings and may contain suitable hardened bearing inserts 26L and 26R (see also FIGS. 3 and 4). The drive sleeve 15 and the piston driver structures, generally indicated at 16L and 16R, because they are secured to the pistons 22, are restrained from rotation and thus follow a non-rotational orbital translation motion that is transferred to the pistons. The orbit of each piston is identical to the others except for a fixed radial displacement. The arrangement in which the eccentric drive members 4, in spaced positions along the drive shaft 2, simultaneously actuate the orbital movement of the sleeve 15 adds significantly to the stability of the compressor device.

The drive mechanism for the chambers 22 creates the orbital motion of the drive sleeve 15 that drives the pistons. In this case, however, the orbital motion of the drive sleeve 15 is converted to reciprocating horizontal motion to drive the upper and lower chambers 22U and 22B and to reciprocating vertical motion to drive the two side chambers 22R and 22L.

The bearings 14L and 14R are positioned within and drive the sleeve 15 in a non-rotational orbit, meaning that the sleeve 15 (and also the piston drive structures 16 and 16R) follows an orbital path but does not rotate about its own axis. The piston drive structure 16R has four radially extending brackets 17U, 17B 17L and 17R. The other drive structure 16L carries identical brackets 17, partially visible in FIG. 2. The upper brackets 17U are secured to the upper piston 18U; the two pairs of side brackets 17L and 17R are secured respectively to the side pistons 18L and 18R, and the bottom brackets 17B are secured to the bottom piston 18B. By this means when the drive shaft 2 is rotated, each of the pistons is driven in a circular orbit in a plane perpendicular to the longitudinal axis of the shaft 2.

To avoid an excessive load on the piston seals, the chambers 22U, 22B, 22L and 22R are driven by separate drive means along linear reciprocating paths, parallel with and displaced from the longitudinal axis of the drive shaft 2, that correspond to the displacements of the pistons in the respective directions. This driving force is applied to the chambers by separate mechanisms secured to the ends of the chambers.

The drive mechanism for the left hand ends of the chambers will now be described, it being understood that a similar drive arrangement is connected to the opposite ends of the chambers. The drive sleeve 15 extends beyond the piston drive structure 16L and carries a pair of ears **32*a* and 32*b* that extend laterally into corresponding notches 34*a* and 34*b* on the inner surface of an orbital chamber drive structure, generally indicated at 36L**.

The orbital chamber drive structure 36L has a pair of oppositely disposed inner drive rails 38 extending vertically along the sides. Only one drive rail 38 is visible in the view of FIG. 2, but the other rail is positioned symmetrically along the opposite side surface of the structure.

This orbital chamber drive structure 36L is positioned within a first linear chamber drive structure, generally indicated at 42L, in which the inner drive rails 38 respectively engage outer drive rails 44, only one of which is visible in FIG. 2. These mating drive rails permit vertical movement of the orbital chamber drive structure 36L within the linear chamber drive structure 42L, but do not permit horizontal movement of the orbital drive structure within the linear chamber drive structure.

Vertical or rotational movement of the linear chamber drive structure 42L is prevented by a pair of guide rails **46*a* and 46*b* that are fixed to the linear chamber drive structure 42L and are supported by two sets of guide pads 48*a* and 48*b* mounted for horizontal sliding movement in a fixed support plate 52L that may form part of the compressor housing 25 of FIG. 1**.

One of the end plates 54UL of the chamber 22U and one of the end plates 54BL of the chamber 22B form an integral part of the linear chamber drive structure 42L. The plate 54UL forms the left end plate of the upper chamber 22U and the plate 54BL forms the left end plate of the bottom chamber 22B.

When the drive shaft 2 rotates, the sleeve 15 follows a non-rotational orbital path. This movement causes the orbital drive structure 36L to ride up and down in the linear chamber drive structure 42L while moving that structure horizontally in a reciprocating motion.

An equivalent mechanism (not shown) operated by the eccentric drive member 4R through the bearing 14R produces an identical motion of the end plates at the opposite ends of the chambers 22U and 22B. The chambers 22U and 22B are thus caused to move laterally in synchronism with the horizontal component of motion of the pistons 18U and 18B.

To drive the chambers 22R and 22L, the orbital chamber drive structure 36L is provided with a second pair of drive rails 56 that extend respectively horizontally along the upper and lower surfaces of the orbital chamber drive structure 36L and are offset along the axis of the shaft 2 from the drive rails 38. It is not necessary that the drive rails 38 and 56 be axially displaced along the drive shaft 2 but, if desired, may be positioned in a common plane. These drive rails 56 respectively engage upper and lower cooperating outer drive rails 58 in a second linear chamber drive structure, generally indicated at 62L, that permit horizontal movement within the second linear chamber drive structure. Only the upper drive rail 56 on the orbital chamber drive structure 36L and the lower drive rail 58 on the second linear chamber drive structure 62L are shown in this view, but opposing symmetrical rail drives are provided. The meshing drive rails on both the vertical and horizontal surfaces are provided with ball or roller bearing elements or other means to minimize the friction and wear of the reciprocating surfaces.

Horizontal or rotational movement of the second linear chamber drive structure 62L is prevented by a pair of guide rails **63*a* and 63*b* attached to the drive structure and mounted for vertical sliding movement in the fixed support 52L by means of two sets of guide pads 64*a* and 64*b***.

An end plate 66L that forms the left end of the left side chamber 22L and an end plate 66R that forms the left end of the right side chamber 22R form integral parts of the second linear chamber drive structure 62L.

As with the chambers 22U and 22B, the side chambers are driven to correspond to the vertical component (as shown) of the orbital movement of the pistons 18L and 18R. When the orbital chamber drive structure 36L moves in a circular orbit, the second linear chamber drive structure 62L reciprocates vertically driving the chambers 22L and 22R in a vertical reciprocating path. As stated above, a duplicate chamber driving mechanism (not shown) is provided and is driven by the orbital motion of the drive sleeve 15 to impart the appropriate motion to the right hand end of each of the chambers.

Analysis of the forces acting upon this assembly shows that the forces generated by acceleration and deceleration of the chambers as they reciprocate far exceeds the forces generated by the gases being compressed. Earlier versions, in which the chambers are moved by pressure exerted on the piston seals or through a separate set of low friction or rolling element drive components, generally have high frictional losses reducing the efficiency of the system. In both such arrangements the pistons are generally located some distance from the drive shaft and any differential pressure between them and the driving mechanism, caused partially by unavoidable tolerances in the construction, thermal expansion or wear, can result in the creation of significant twisting or rotational torque on the chamber system as a product of the acceleration force and the eccentricity. In theory, the acceleration forces imparted by each of the opposing pistons on its associated chamber is identical, but in actual practice, one piston or the other usually exerts a large proportion of the total chamber-driving force. This results in much higher loads than would be predicted on the sliding or bearing surfaces that allow the chambers to reciprocate, increasing the friction losses and decreasing the useful life.

This invention embodies a sliding or rolling interface between the eccentric drive element and the end plates of the chambers that allows the chamber drive structure to move horizontally for one pair of chambers and vertically for the other pair of chambers.

Friction losses are preferably minimized by using one of several rolling element configurations, while the twisting moments are dramatically reduced by having the drive forces resolved as near the centerline of the mass of the end plate and chamber assembly as possible. The twisting or rotational moments with respect to the upper and lower chambers 22U and 22B are resisted by the two guide rails **46*a* and 46*b* that are located respectively on the mass centerlines of the chamber end plates 54U and 54B. These guide rails ride, respectively, on the guide pads 48*a* and 48*b* that are slidably attached for horizontal sliding movement to the fixed support plate that may form part of the housing of the displacement apparatus. The guide rails 46*a* and 46*b* are positioned as far as possible from the centerline of the drive shaft 2. By increasing the effective lever arm in this way, any twisting or overturning moment is resolved with minimum force, thus permitting the guide pads 48*a* and 48*b* to utilize a self-lubricated bearing material. The same considerations apply to the design of the end-plate chamber assemblies for the right and left chambers 22R and 22L** and for the symmetrical constructions associated with the end plates that form the opposite ends of the chambers.

With this arrangement, rolling bearing elements react with the largest forces to minimize friction losses, while maintaining minimum eccentricity between the centerline of the drive shaft 2 and centerline of the force that counteracts the overturning or twisting moments. As stated above this allows the use of simple sliding pads to resolve the much smaller gas pressure forces.

Figure 6:
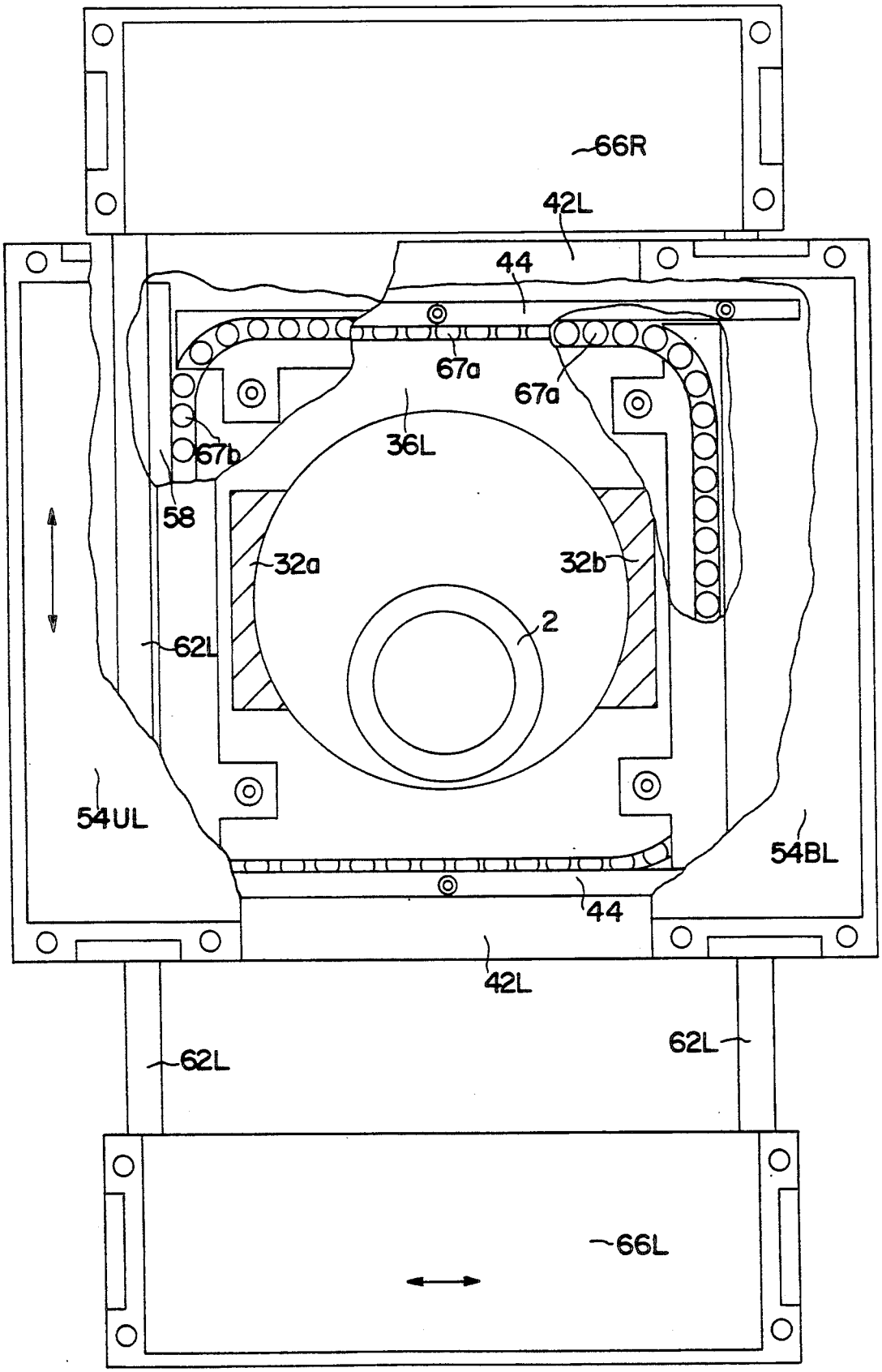
FIG. 6 is a diagrammatic cross sectional view illustrating further details of the chamber drive mechanism of FIG. 3.
Figure 7:
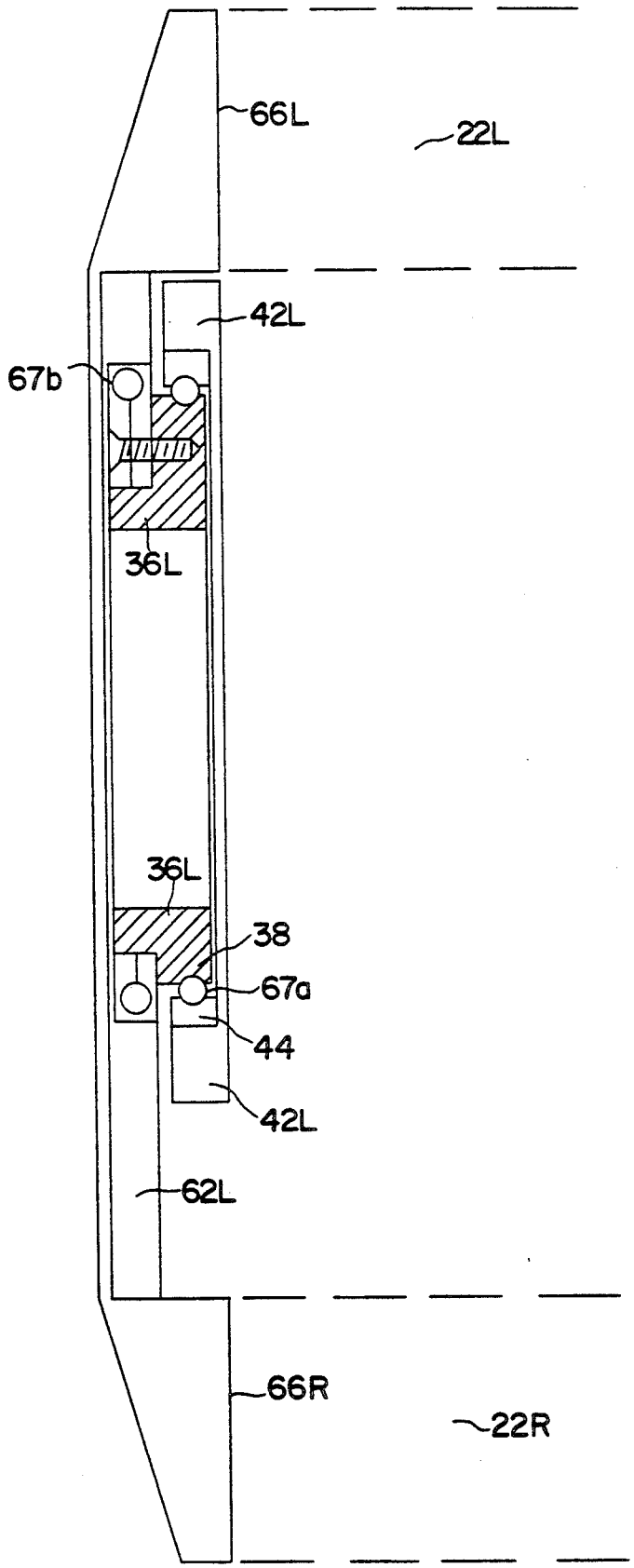
FIG. 7 is a sectional view of FIG. 3 showing the arrangement of the inner and outer continuous bearing races.

Various arrangements for counteracting the overturning forces are shown diagrammatically in FIGS. 5 to 11. In the embodiment shown in FIG. 5, a recirculating ball bearing system is positioned between the orbital chamber drive structure 36L and the end plates of the chambers. A somewhat more detailed illustration of this construction is shown in FIGS. 6 and 7. In this example, (FIG. 5) the upper and lower chambers 22U and 22B are mounted for horizontal movement. The pistons, represented symbolically at 18U and 18B in this view, follow an orbital path as the chambers reciprocate. As before, this orbital drive movement is provided by the orbital chamber drive structure 36L. This orbital drive structure is confined by the chamber drive structure, or any structure secured thereto, indicated in this view diagrammatically at 42L, and the pistons 18U and 18B. The outer drive rails 44 are part of the chamber drive structure 42L, or a structure secured thereto, and the inner drive rail 38 is part of the orbital chamber drive structure 36L. Free floating ball bearings **67*a* are positioned between the inner drive rails 38 and the outer drive rails 44. To permit recirculation of the ball bearings, a recirculation track is provided through the pistons 18U and 18L. This ball bearing track may be through the pistons proper or it may be through appropriate structures forming part of the piston assemblies. With this arrangement, the ball bearings do not reciprocate, but follow a 360-degree recirculation path. As before, the reciprocating motion is guided by the guide rails 46***a* and 46*b* and the guide pads 48*a* and 48*b*.

As shown by FIGS. 6 and 7, a separate set of recirculation ball bearings 67*b* is provided in connection with the vertical reciprocation of the side chamber drive structure 62L.

Figure 8:
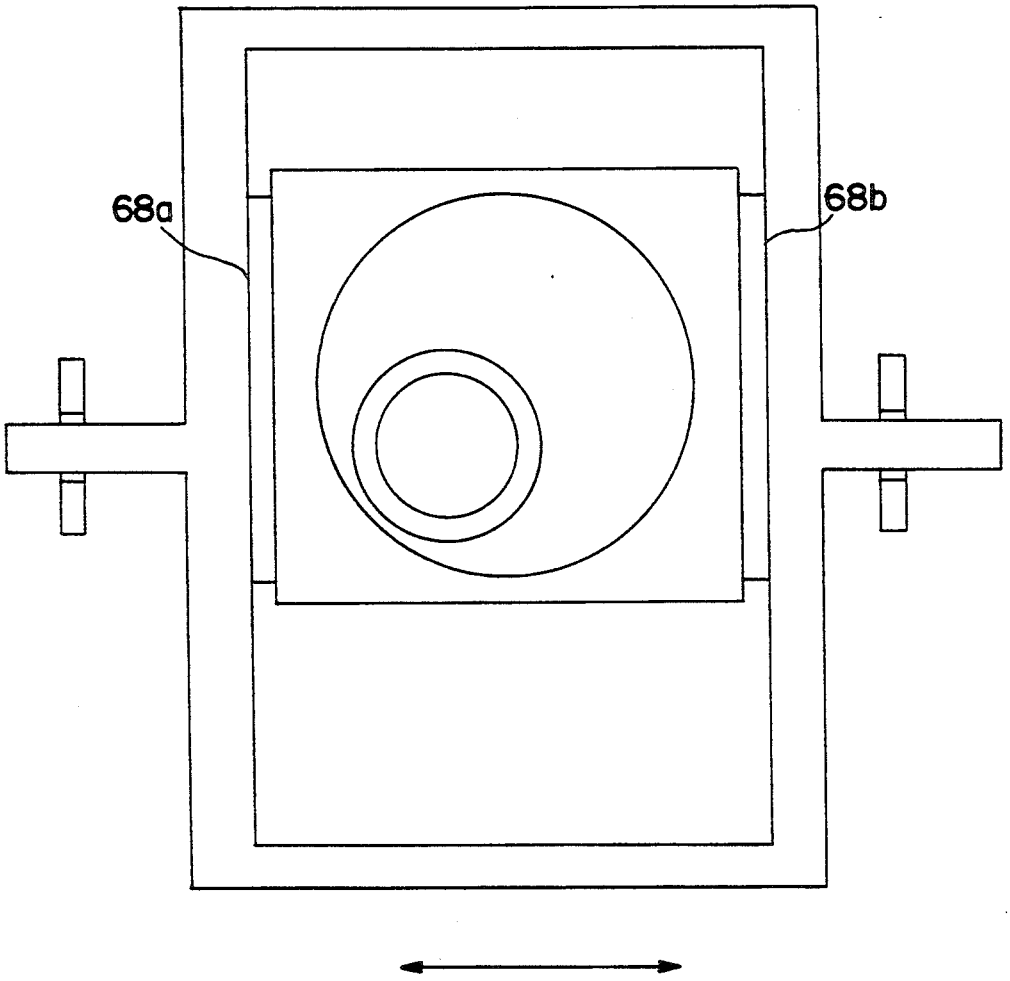
FIG. 8 is a diagrammatic sectional view illustrating the use of low resistance sliding surfaces to replace the ball bearing arrangement of FIG. 3.

FIG. 8 illustrates an arrangement in which the recirculating ball bearings are replaced with low-friction sliding surfaces 68*a* and 68*b*. This arrangement provides a low cost simple displacement apparatus for less demanding applications.

Figure 9:
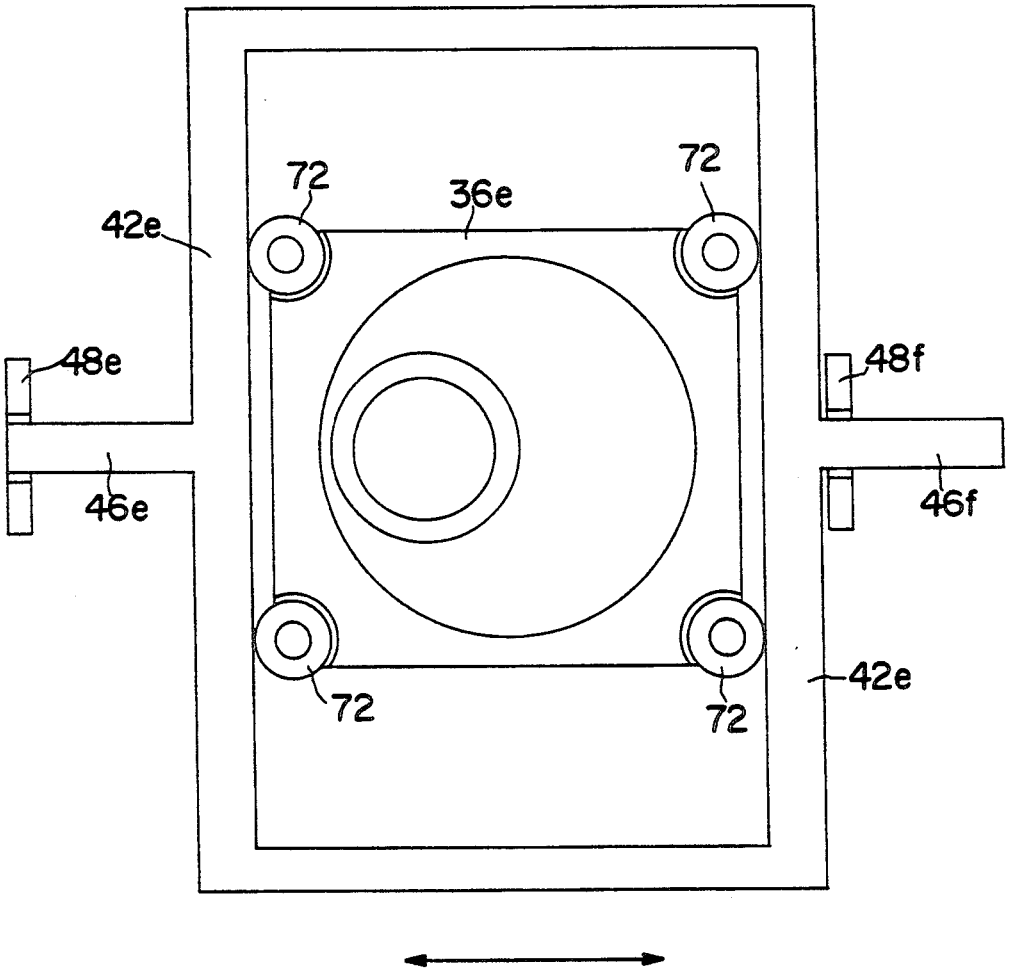
FIG. 9 is a diagrammatic sectional view of a orbital chamber drive structure using drive rollers mounted on the orbital drive element for the transfer of the chamber driving forces.

FIG. 9 illustrates diagrammatically an arrangement where the recirculating ball bearings have been replaced by four small rolling elements 72 that resolve the twisting moments of the chambers. These rolling elements are mounted on the orbital chamber drive structure 36*e* and ride on the guide rails that form part of the end plate drive structure represented diagrammatically at 42*e* and 54*f*. As in the previous examples, rotary or twisting moments are resisted by the guide rails 46*e* and 46*f* operating respectively with the guide pads 48*e* and 48*f*.

Figure 10:
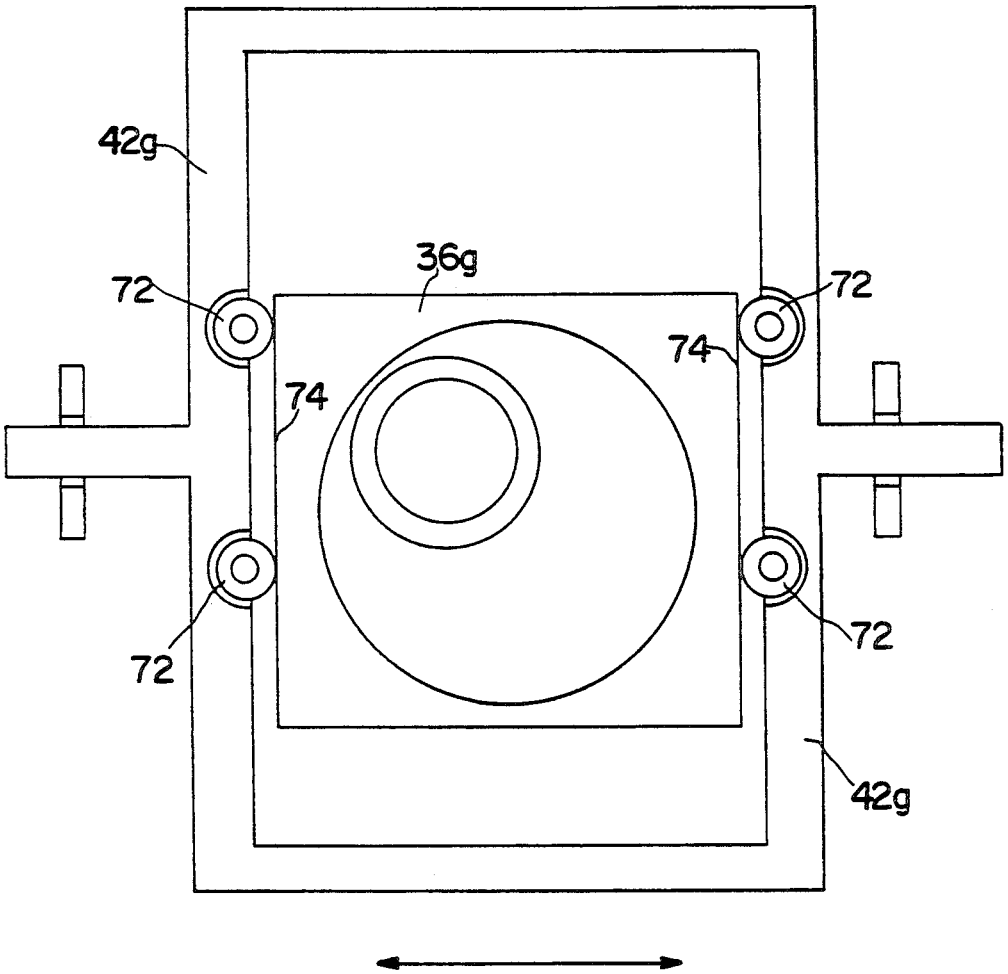
FIG. 10 shows a construction generally similar to that of FIG. 9 in which the drive rollers are secured to the transfer members secured to the chamber.

FIG. 10 shows an arrangement similar to the one represented by FIG. 9 in which the rolling elements 72 are mounted on the end plate structure 42*g* and ride on suitable guide rails 74 that form part of the orbital chamber drive structure 36*g*.

Figure 11:
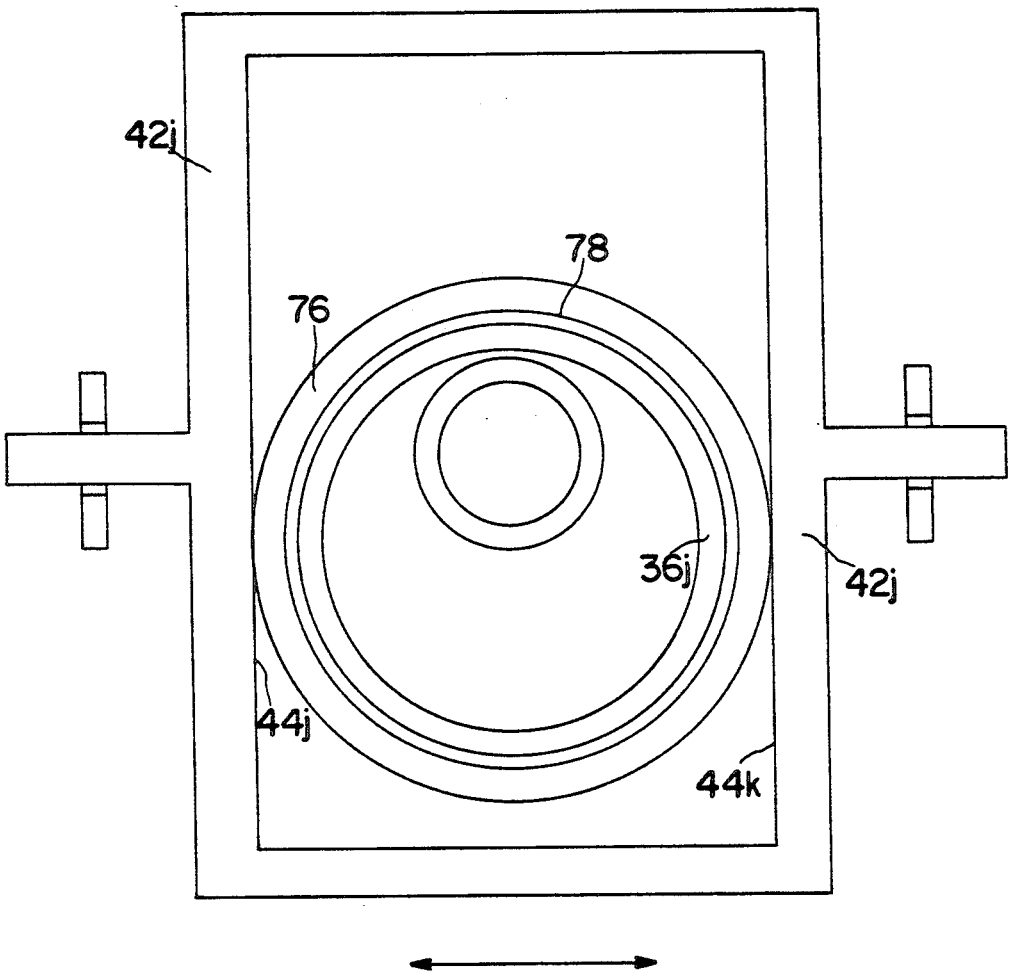
FIG. 11 is a diagrammatic section illustrating the use of a circular component mounted on the outer race of an orbital drive unit.

FIG. 11 illustrates diagrammatically another embodiment in which an inner drive rail 76 is circular in form and is mounted on the outer race of a drive bearing 78 slightly less than the distance between the outer guide rails 44*j* and 44*k* so that it can only make contact with one rail at any given time. This arrangement provides high efficiency, a simple construction and eliminates any possibility of jamming between the orbital drive structure 36*j* and the end plate drive structures 42*j*. The operation is based on a single-point rolling contact that minimizes the negative effects of tolerance reinforcements caused by changes in temperature, manufacturing tolerances and wear.

We claim:

1. The method of providing continuous fluid displacement including the steps of providing a movable chamber with a movable piston therein, driving said piston in a non-rotational orbit, generating a reciprocating force independent of interaction between said piston and said chamber, and driving said chamber with said force along a linear reciprocating path with a displacement equal to the component of motion of said piston in a direction parallel with said path.

2. The method of providing continuous fluid displacement including the steps of providing a movable chamber with a movable piston therein, generating at spaced points two eccentric movements, joining said eccentric movements by a rigid drive sleeve, driving said piston in a non-rotational orbit by rigid means connected at spaced points to said drive sleeve, and generating from the movement of said drive sleeve by means independent of said rigid means a reciprocating linear movement of said chamber equal in stroke to the diameter of the orbital movement of said piston.

3. In a positive displacement apparatus, the combination comprising drive means for generating an eccentric motion, first, second, third and fourth displacement chambers positioned at ninety degree angles from each other to form two sets of opposing chambers, means supporting each of said chambers for reciprocating lateral movement, four pistons each mounted in one of said chambers, first motion transfer means coupled to said drive means for driving said pistons in orbital paths, and second motion transfer means coupled to said drive means and rigidly connected to said chambers for driving each of said chambers along a reciprocating linear path.

4. The combination as claimed in claim 3 wherein said drive means includes first and second spaced eccentric members, and a rigid drive sleeve encompassing said eccentric members.

5. The combination as claimed in claim 3 including slidable means coupled to said second motion transfer means for resisting radial movement of said chambers.

6. The combination as claimed in claim 3 including means connecting said first and third chambers into an integral structure for simultaneous lateral movement, and means connecting said second and fourth chambers into an integral structure for simultaneous lateral movement.

7. In a positive displacement apparatus, the combination comprising eccentric drive means for generating an orbital motion, a first displacement chamber, means supporting said chamber for reciprocating lateral movement thereof, a first piston moveably mounted within said chamber, first drive means operatively coupled to said eccentric drive means for imparting an orbital movement to said piston, and second drive means operatively coupled to said eccentric drive means and rigidly secured to said chamber for producing reciprocal motion of said chamber.

8. The combination as claimed in claim 7 wherein said eccentric drive means includes first and second spaced eccentric members, and a rigid drive sleeve encompassing said eccentric members.

9. The combination as claimed in claim 7 including means resisting rotational displacement of said second drive means.

10. The combination as claimed in claim 7 wherein said second drive means includes bearing means forming a continuous path around said eccentric drive means.

11. The combination as claimed in claim 10 wherein said bearing means includes ball bearings in a continuous path permitting free circulation thereof in a path around said eccentric drive means.

12. The combination as claimed in claim 7 including intake and exhaust ports operatively connected to said chamber and operatively responsive to lateral movement of said chamber.

13. The combination as claimed in claim 7 wherein said second drive means includes an orbital chamber drive structure having first and second inner drive rails, a linear chamber drive structure secured to said chamber and having first and second outer drive rails engaging respectively said first and second inner drive rails, whereby orbital movement of said orbital chamber drive structure produces linear transverse reciprocating movement of said chamber.

14. The combination as claimed in claim 7 including a second displacement chamber, means supporting said second chamber for reciprocating lateral movement thereof, a second piston moveably mounted within said second chamber, third drive means operatively coupled to said eccentric drive means for imparting an orbital movement to said second piston, and fourth drive means operatively coupled to said second eccentric drive means and rigidly secured to said second chamber for producing reciprocal motion of said chamber.

15. The combination as claimed in claim 14 including means for resisting rotational movement of said fourth drive means while permitting reciprocal motion thereof.

16. The combination as claimed in claim 14 including a drive shaft operatively connected to said eccentric drive means, and wherein said first and second chambers are positioned in a plane perpendicular to the longitudinal axis of said drive shaft.

17. The combination as claimed in claim 14 including means connecting said first and second chambers into an integral structure for simultaneous lateral movement.

* * * * *